US010064461B2

(12) United States Patent
Roos

(10) Patent No.: US 10,064,461 B2
(45) Date of Patent: Sep. 4, 2018

(54) LIGHT STRING WITH LIGHTING ELEMENTS SURROUNDED BY DECORATIVE SHROUD AND RETAINED BY SNAP-FIT ENCLOSURE SYSTEM

(71) Applicant: I PEE HOLDING, LLC, Vernon Hills, IL (US)

(72) Inventor: Christian Brayian Roos, Quito (EC)

(73) Assignee: I PEE HOLDING, LLC, Vernon Hills, IL (US)

( * ) Notice: Subject to any disclaimer, the term of this patent is extended or adjusted under 35 U.S.C. 154(b) by 7 days.

(21) Appl. No.: 15/244,807

(22) Filed: Aug. 23, 2016

(65) Prior Publication Data

US 2017/0003003 A1 Jan. 5, 2017

Related U.S. Application Data

(60) Provisional application No. 62/210,650, filed on Aug. 27, 2015.

(51) Int. Cl.

| | |
|---|---|
| ***A44C 15/00*** | (2006.01) |
| ***F21V 21/002*** | (2006.01) |
| ***F21S 4/10*** | (2016.01) |
| *F21Y 115/10* | (2016.01) |
| *F21V 23/04* | (2006.01) |
| *F21W 121/00* | (2006.01) |

(52) U.S. Cl.

CPC ..... *A44C 15/0015* (2013.01); *A44C 15/005* (2013.01); *F21S 4/10* (2016.01); *F21V 21/002* (2013.01); *F21V 23/04* (2013.01); *F21W 2121/00* (2013.01); *F21Y 2115/10* (2016.08)

(58) Field of Classification Search

CPC ..... F21V 19/004; A44C 15/0015; F21S 4/10

See application file for complete search history.

(56) References Cited

U.S. PATENT DOCUMENTS

| | | | | |
|---|---|---|---|---|
| 4,667,276 | A * | 5/1987 | Cheng | F21V 19/0005 362/249.01 |
| 5,366,386 | A * | 11/1994 | Liao | F21V 21/002 439/419 |
| 5,666,021 | A * | 9/1997 | Myson | F21V 19/0005 313/318.01 |
| 5,718,504 | A * | 2/1998 | Huang | F21V 21/002 362/267 |
| 5,759,062 | A * | 6/1998 | Chen | F21V 21/002 439/280 |
| 5,788,362 | A * | 8/1998 | Chou | F21V 19/006 362/249.01 |

(Continued)

*Primary Examiner* — Jong-Suk (James) Lee
*Assistant Examiner* — Christopher E Dunay
(74) *Attorney, Agent, or Firm* — Levenfeld Pearlstein, LLC

(57) ABSTRACT

A light string with a snap-fit enclosure includes a conductor, a light element mounted to the conductor, a shroud having a body having an open interior and a neck, the neck having an opening therein, open to the body interior and a cap configured to fit onto the neck. Cooperating locking elements are positioned in the cap and on the neck to lock the cap to the neck, such that the cap is secured to the neck and the light element secured within the shroud without the need for an external fastener. At least one of the cap and the neck have at least two cut-outs formed therein opposing one another and defining a channel. The channel is configured to receive the conductor with the cap secured to the neck.

8 Claims, 4 Drawing Sheets

(56) References Cited

U.S. PATENT DOCUMENTS

| | | | | |
|---|---|---|---|---|
| 6,481,875 | B1 * | 11/2002 | Bryant | F21V 17/06 362/123 |
| 6,648,492 | B1 * | 11/2003 | Shih | F21V 21/092 362/249.01 |
| 2010/0110668 | A1 * | 5/2010 | Marlonia | F21V 21/15 362/152 |
| 2015/0016125 | A1 * | 1/2015 | Lin | F21K 9/30 362/396 |
| 2016/0230966 | A1 * | 8/2016 | DeFrancesco | F21V 17/04 |

* cited by examiner

LIGHT STRING WITH LIGHTING ELEMENTS SURROUNDED BY DECORATIVE SHROUD AND RETAINED BY SNAP-FIT ENCLOSURE SYSTEM

BACKGROUND

The following description relates to a light string, for example, a novelty lighted necklace, ornamental hanging lights and the like.

Light strings or string lights are typically outdoor ornamental devices that include a plurality of lights that are powered and hung from shielded or insulated wires. These devices can also be used, as, for example, a necklace, when the ends of the string are secured to one another. And, in that light emitting diode (LED) technology has become so common, such light strings can be used with greater degrees of safety, since LED are typically low power (low voltage) and do not generate much heat in use.

Outdoor string lights may include a bare bulb mounted in a socket in which the electrical connections are terminated. Other outdoor string lights may include a shade or other element that is used to shade or protect the bulb from breakage.

Ornamental, wearable light strings can include a cover or shroud over the bulb and socket to provide a festive or other aesthetically pleasing or amusing feature. For example, a pumpkin cover or shroud formed form a translucent or partially translucent material (such as plastic) can be positioned over and secured to the light string to provide a pleasing appearance when the lights are illuminated.

In known arrangements, the shroud or cover is fitted onto the socket and secured by screws or other fasteners. In such an arrangement, the shroud and socket may have predrilled or preformed holes to accommodate the fasteners. In order assemble the light strings, the shroud is fitted onto the socket and metal fasteners are driven into the shroud and socket. In that these parts are often fabricate from plastics, there is the opportunity to over-drive or under-drive the fastener which can result in the shroud and/or socket to break or become compromised.

Accordingly, there is need for a light string assembly configuration that eliminates the need for fasteners and in particular, metal fasteners. Desirably such an arrangement reduces the number of parts as well as the time and labor required to assemble such light strings.

SUMMARY

A light string has a snap-fit enclosure. The light string includes a conductor and at least one light element mounted to the conductor. A shroud has a body having an open interior and a neck. The neck has an opening therein, open to the body interior.

A cap is configured to fit onto the neck. In an embodiment, cooperating locking elements are positioned in the cap and on the neck to lock the cap to the neck, such that the cap is secured to the neck and the light element secured within the shroud without the need for an external fastener.

In an embodiment, at least one of the cap and the neck has at least two cut-outs formed therein opposing one another to define a channel. The channel is configured to receive the conductor with the cap secured to the neck. In an embodiment the cut-outs are formed in the neck with the conductor positioned in the channel recessed from an end of the neck. In an embodiment, the cut-outs are formed in the cap with the conductor positioned in the channel. In an embodiment, cut-outs are formed in the neck and in the cap that are configured to cooperate to define the channel, and the conductor is positioned in the channel.

In an embodiment, the cooperating locking elements include a ramped surface and a lip on one of both of the cap and the neck.

In an embodiment of the light string the neck includes four cuts-outs to define four sections, and at least two of the sections include a ramped surface and a lip. In such an embodiment, the cap includes corresponding ramped surfaces and lips to cooperate with and engage the ramped surfaces and lips of the neck.

An embodiment of the light string includes a controller. The controller includes one or more batteries and a switch. The light string can includes multiple light elements, for example, at least three elements mounted to the conductor spaced from one another, each light element enclosed within a shroud and secured therein by a cap. The light elements can be, for example, LEDs.

An embodiment of a light string with a snap-fit enclosure includes a conductor, a plurality of light elements mounted to the conductor and a controller. The controller includes one or more batteries and a switch, and circuitry to control a lighting scheme of the light elements.

The light string includes a shroud over each of the light elements. Each shroud has a body having an open interior and a neck. The neck has an opening therein, open to the body interior for receiving the light element. The neck has a plurality of cut-outs, for example, four cut-outs formed therein equally circumferentially spaced from one another to define four sections. Two opposing cut-outs are configured to receive the conductor, such that the conductor is recessed from an end of the neck.

A cap is configured to fit onto the neck. The cap having at least two cut-outs therein cooperating with the cut-outs in the neck such that when the cap is positioned on the neck, the cut-outs in the neck and the cut-outs in the cap define a channel therethrough for passage of the conductor.

In such an embodiment cooperating locking elements are positioned in the cap and on the neck to lock the cap to the neck with the conductor positioned in the channel. In this manner, that the cap is secured to the neck and the LED light elements are secured within the shroud without the need for an external fastener. In an embodiment, the cooperating locking elements include a ramped surface and a lip on one of both of the cap and the neck.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 2:
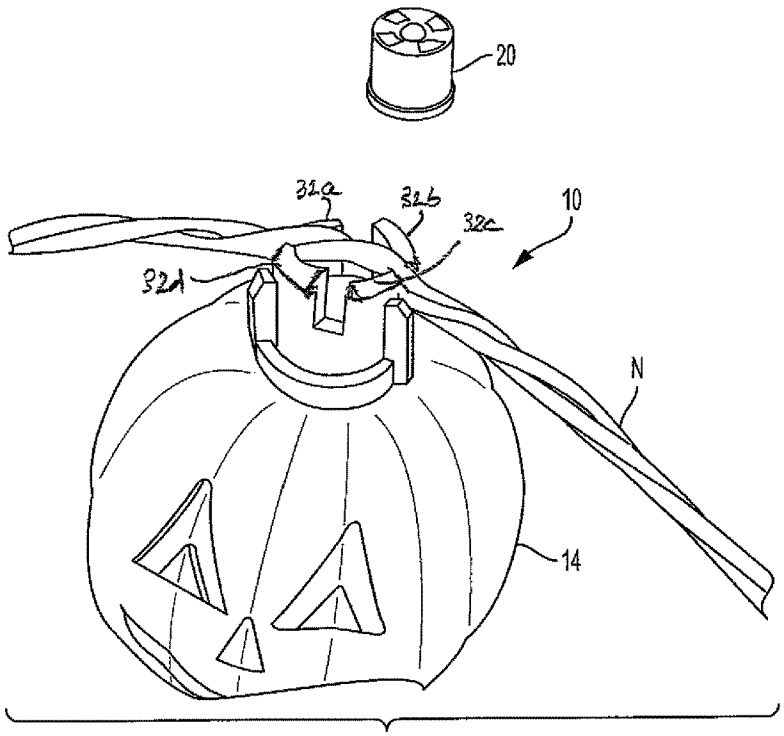
FIG. 2 is an illustration of the embodiment of the light string of FIG. 1 with the light inserted into the shroud and the cap removed, again, for clarity of illustration, and showing the conductors positioned in the shroud recesses.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

Figure 1:
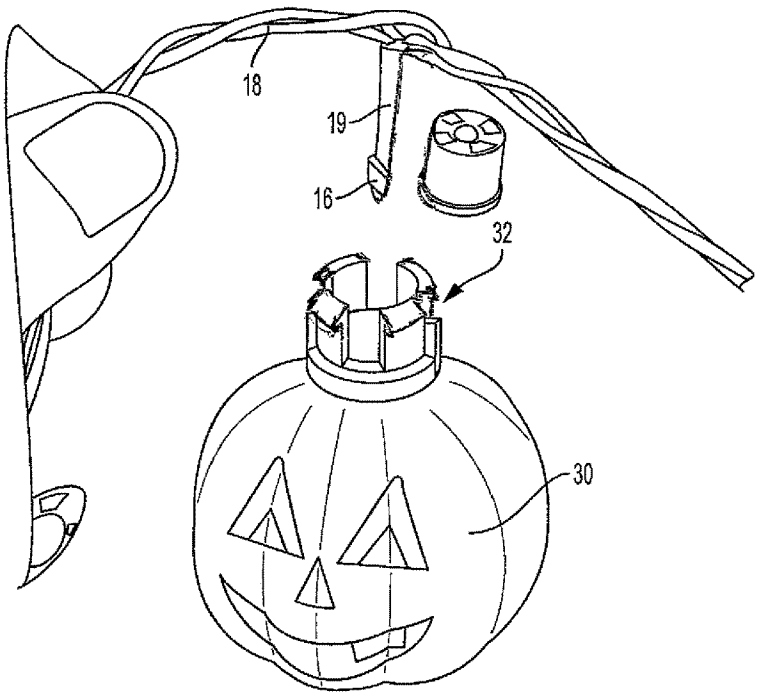
FIG. 1 illustrates an embodiment of a light string shown in a partially exploded view with the light removed from the shroud and the cap removed for clarity of illustration.
Figure 3:
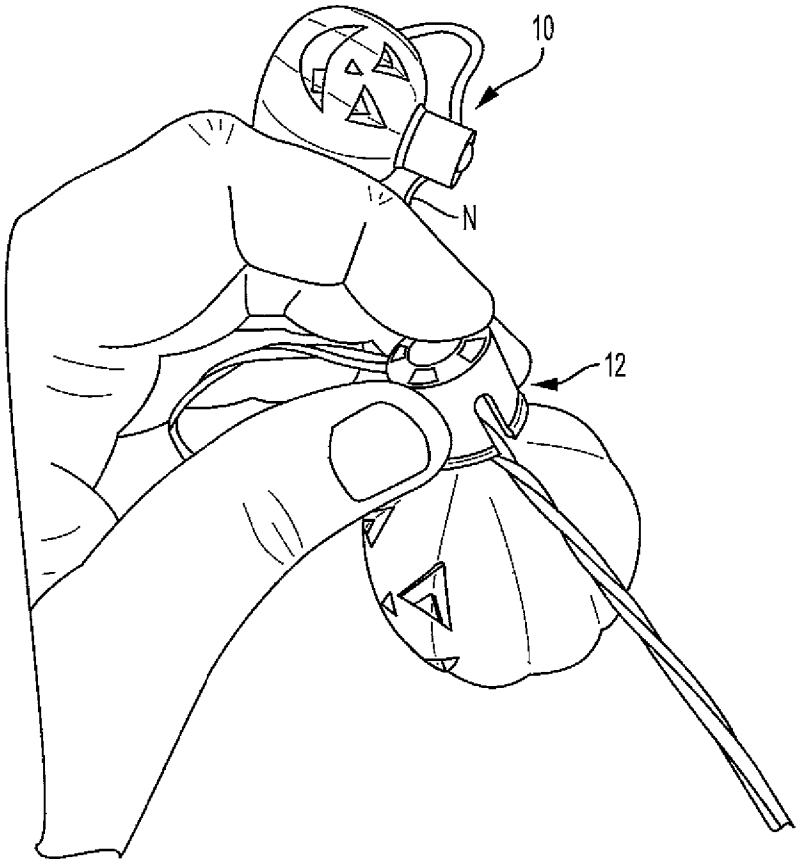
FIG. 3 illustrates the cap as it is installed on the shroud with the conductors positioned in the cap recesses.
Figure 4:
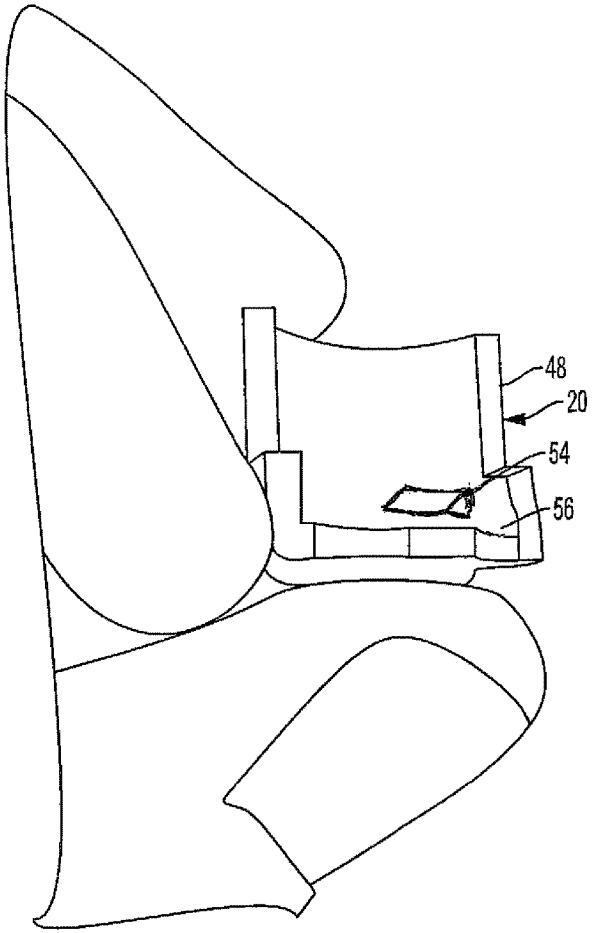
FIG. 4 is partial illustration showing the interior of the cap.
Figure 5:
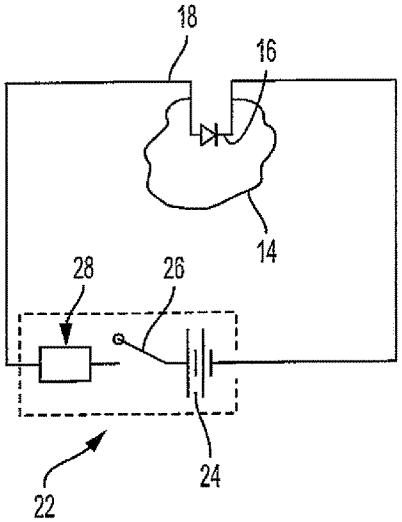
FIG. 5 is a schematic illustration of an electrical circuit for the light string.
Figure 8:
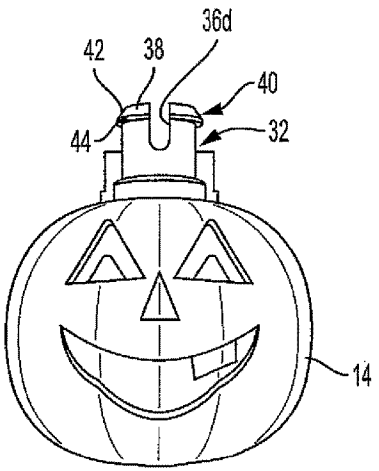
FIG. 8 is a front view of the shroud.
Figure 11:
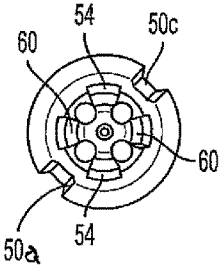
FIG. 11 is a bottom view of the cap, showing the interior thereof.
Figure 7:
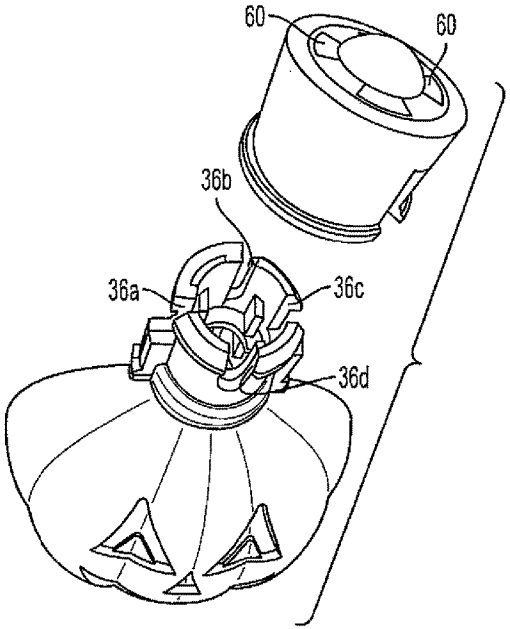
FIG. 7 is an exploded view of the shroud and cap without the light string.
Figure 10:
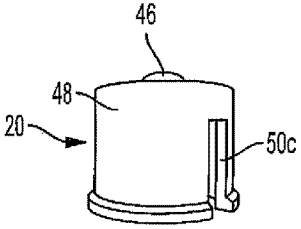
FIG. 10 is a front view of the cap.
Figure 6:
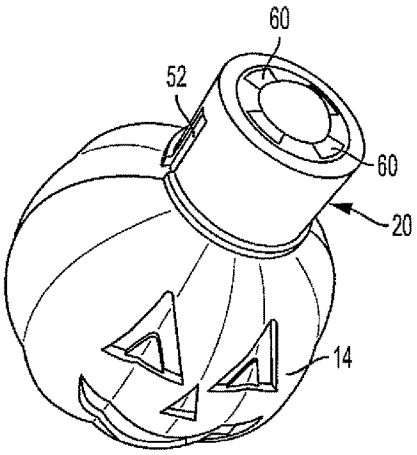
FIG. 6 is a perspective view of the shroud and cap without the light string.
Figure 9:
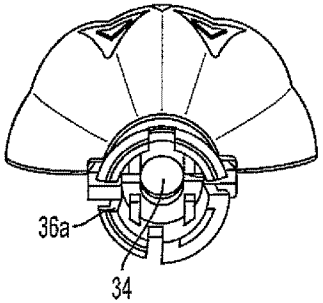
FIG. 9 is a partial top view of the shroud, showing the shroud opening.

Referring to FIG. 1 there is shown a light string novelty device 10 with a snap-fit enclosure 12. The device 10 includes a shroud 14, one or more light elements 16 positioned on a conductor or conductors 18, a cap 20 and a controller 22 (see, FIG. 6). The shroud 14 can take many forms or shapes, such as the illustrated Halloween pumpkin decoration. In an embodiment the shroud 14 is formed from plastic so that when the light elements 16 are illuminated the light is visible though the shroud 14 and the shroud 14 illuminates to create a pleasing aesthetic effect. The shroud 14 can take many other shapes and configurations which other shapes and configurations are within the scope and spirit of the present disclosure.

The light elements 16 on the light string (attached to the conductors 18) are powered by a power source 24, such as one or more batteries that can be positioned within the controller 22. The controller 22 can include a switch 26 and circuitry 28 to provide a variety of illuminating functions, such as on-off, fast and or slow blinking scenarios, and the like. In a present embodiment, the lights 16 are light emitting diodes (LEDs) or other lower heat-generating illuminating elements. In this manner, the light string 10 can be formed as a necklace N or the like to be worn around a user's neck, without concern as to heat that is generated from the light elements 16.

The shroud 14 has an open interior 30 and includes an upstanding neck 32 that is configured to receive the conductor 18 and the cap 20. The neck 32 has an opening 34 that is open to the shroud interior 30, through which the light element 16 is passed for insertion into the shroud interior 30. In an embodiment, the neck 32 has a plurality of recesses or cut-outs 36, two of which 36*a*, 36*c* are configured to receive the conductor 18 when the light element 16 is inserted into the shroud 14. In this manner, the conductor 18 is below an uppermost edge 38 of the neck 34, that is, the conductor 18 is recessed from the uppermost edge 38 of the neck 34. The light element 16 can be connected to the conductor 18 by an extension piece 19 so that the light element 16 can be inserted into a desired location within the shroud 14.

The neck uppermost edge 38 includes a hook portion 40 formed along the edge. The hook portion 40 includes a ramped or inclined surface 42 and a lip or ledge 44 at an end of the ramped surface 42. In a present embodiment the neck 32 is quadfurcated (see, FIGS. 2 and 7, 32*a-d*), that is, divided in to four parts or sections, and each section 32*a*-32*d* can have a ramped or inclined surface 42 and a lip or ledge 44 at an end of the ramped surface 42. At least two of the recesses or cut-outs (36*a*, 36*c*) are formed opposing each other to receive the conductor 18.

The cap 20 is formed so as to snap on to the neck 32. In a present embodiment, the cap 20 includes a top portion 46 and a depending skirt 48. The skirt 48 includes at least two recesses or cut-outs 50*a*, 50*c* that cooperate with the recesses 36*a*, 36*c* in the neck 32. In this manner, the cap 20 is snapped onto the neck 32 with the neck recesses or cut-outs 36*a*, 36*c* aligned with the cap recesses or cut-outs 50*a*, 50*c* to define a closed channel 52. The conductors 18 are captured in the closed channel 52 to secure the conductors 18 in the channel 52 and the lighting element 16 in the shroud 14. The neck recesses or cut-outs 36*a*, 36*c* and the cap recesses or cut-outs 50*a*, 50*c* (that define the channel 52) are configured so as to capture the conductors 18, but not damage (e.g., by pinching) the conductors 18 when the cap 20 is positioned on the neck 32. It will be appreciated that cut-outs 36, 50 can be formed in one or both of the neck 32 and the cap 20 to define the channel 52.

To secure the cap 20 to the neck 32, the cap 20 includes one or more ramped or inclined surfaces 54 and lips or ledges 56 that cooperate with the ramped or inclined surfaces 42 and lips or ledges 44 on the neck 32. The ramped surfaces 54, 42 and lips or ledges 56, 44 define cooperating locking elements in the cap 20 and neck 32. In this manner, as the cap 20 is urged onto the neck 32 the cap inclined surfaces 54 engage the neck inclined surfaces 42, and further urging the cap 20 onto the neck 32 engages the cap lips or ledges 56 with the neck lips or ledges 44. As the lips or ledges 44, 56 cap pass over one another they secure the cap 20 on the neck 32 with the conductors 18 in the channel 52 formed by the neck recesses 36*a,c* and the cap recesses 50*a,c*.

In an embodiment the cap 20 includes openings 58 in the top 46, above the lips or ledges 56. In this manner, the interlocking lips or ledges 44, 56 can be accessed from the top 46 of the cap 20, through the openings 58, so that the cap 20 can be separated from the neck 32 to access the light elements 16 or conductors 18.

Advantageously, the present light string 10 with a snap-fit enclosure 12 permits manufacture of light strings 10 in an efficient and cost effective manner. The components fit and lock into one another quickly without the need for external fasteners, such as screws, rivets or the like.

It should also be understood that various changes and modifications to the presently disclosed embodiments will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A light string with a snap-fit enclosure, comprising:

a conductor;

a light element mounted to the conductor;

a shroud having a body having an open interior and a neck, the neck having an opening therein, open to the body interior;

a cap, the configured to fit onto the neck; and cooperating locking elements positioned in the cap and on the neck to lock the cap to the neck, such that the cap is secured to the neck and the light element secured within the shroud without the need for an external fastener, wherein the cap and the neck have at least two cut-outs formed therein, respective ones of the cap cut-outs and the neck cut-outs cooperating and aligning with one another to define a substantially straight-through path, the substantially straight-through path configured to receive the conductor with the cap secured to the neck, wherein the conductor and light element are non-integral with and separate, apart and removable from the shroud and the cap, and wherein the shroud is substantially enclosed.

2. The light string of claim 1 wherein the light element is an LED.

3. The light string of claim 1 wherein the cooperating locking elements include a ramped surface and a lip on one of both of the cap and the neck.

4. The light string of claim 1 wherein the neck includes four cuts-outs to define four sections, and wherein at least two of the sections include a ramped surface and a lip and wherein the cap includes corresponding ramped surfaces and lips to cooperate with and engage the ramped surfaces and lips of the neck.

5. The light string of claim 1 including a controller, the controller including one or more batteries and a switch.

6. The light string of claim 1 including at least three light elements mounted to the conductor spaced from one another, each light element enclosed within a shroud and secured therein by a cap.

7. The light string of claim 6 including a controller, the controller including one or more batteries and a switch, the controller including circuitry to control a lighting scheme of the light elements.

8. A light string with a snap-fit enclosure, comprising:

a conductor;

a plurality of LED light elements mounted to the conductor;

a controller, the controller including one or more batteries and a switch, the controller including circuitry to control a lighting scheme of the LED light elements;

a plurality of shrouds, each shroud being substantially enclosed and having a body having an open interior and a neck, the neck having an opening therein, open to the body interior, the neck having four cut-outs formed therein equally circumferentially spaced from one another to define four sections, two opposing cut-outs configured to receive the conductor, such that the conductor is recessed from an end of the neck;

a plurality of caps, each cap configured to fit onto the neck of a respective one of the plurality of shrouds, each cap having at least two cut-outs therein cooperating with the cut-outs in the neck such that when the cap is positioned on the neck, the cut-outs in the neck and the cut-outs in the cap define a substantially straight-through path for passage of the conductor; and cooperating locking elements positioned in the cap and on the neck to lock the cap to the neck with the conductor positioned in the straight-through path, such that the cap is secured to the neck and the LED light element secured within the shroud without the need for an external fastener, the cooperating locking elements including a ramped surface and a lip on one or both of the cap and the neck, and wherein the conductor and the plurality of LED light elements are non-integral with and separate, apart and removable from respective ones of their shrouds and caps.

* * * * *